US008635885B2

(12) United States Patent
Mak

(10) Patent No.: US 8,635,885 B2
(45) Date of Patent: Jan. 28, 2014

(54) CONFIGURATIONS AND METHODS OF HEATING VALUE CONTROL IN LNG LIQUEFACTION PLANT

(75) Inventor: John Mak, Santa Ana, CA (US)

(73) Assignee: Fluor Technologies Corporation, Aliso Viejo, CA (US)

( * ) Notice: Subject to any disclaimer, the term of this patent is extended or adjusted under 35 U.S.C. 154(b) by 292 days.

(21) Appl. No.: 13/271,959

(22) Filed: Oct. 12, 2011

(65) Prior Publication Data

US 2012/0090350 A1 Apr. 19, 2012

Related U.S. Application Data

(60) Provisional application No. 61/393,617, filed on Oct. 15, 2010.

(51) Int. Cl.
*F25J 1/00* (2006.01)
*F25J 1/02* (2006.01)

(52) U.S. Cl.
USPC ..... 62/622

(58) Field of Classification Search
USPC ..... 62/618, 619, 620, 622, 630, 631
See application file for complete search history.

(56) References Cited

U.S. PATENT DOCUMENTS

| | | | | |
|---|---|---|---|---|
| 4,157,904 | A | 6/1979 | Campbell et al. | |
| 4,251,249 | A | 2/1981 | Gulsby | |
| 4,617,039 | A | 10/1986 | Buck | |
| 4,690,702 | A * | 9/1987 | Paradowski et al. | 62/621 |
| 5,114,450 | A * | 5/1992 | Paradowski et al. | 62/625 |
| 5,275,005 | A | 1/1994 | Campbell et al. | |
| 5,325,673 | A | 7/1994 | Durr et al. | |
| 5,363,655 | A * | 11/1994 | Kikkawa et al. | 62/613 |
| 5,799,507 | A | 9/1998 | Wilkinson et al. | |
| 5,890,378 | A | 4/1999 | Rambo et al. | |
| 6,308,531 | B1 | 10/2001 | Roberts et al. | |
| 6,662,589 | B1 * | 12/2003 | Roberts et al. | 62/425 |
| 7,041,156 | B2 | 5/2006 | Bras et al. | |
| 7,257,966 | B2 * | 8/2007 | Lee et al. | 62/620 |
| 2006/0130520 | A1 | 6/2006 | Patel | |
| 2006/0130521 | A1 | 6/2006 | Patel | |
| 2007/0157663 | A1 | 7/2007 | Mak et al. | |
| 2010/0024477 | A1 * | 2/2010 | Roberts et al. | 62/620 |
| 2010/0132405 | A1 | 6/2010 | Nilsen | |
| 2010/0281915 | A1 * | 11/2010 | Roberts et al. | 62/612 |

FOREIGN PATENT DOCUMENTS

| | | |
|---|---|---|
| EP | 0360229 | 3/1990 |
| EP | 0612968 | 8/1994 |

* cited by examiner

*Primary Examiner* — John Pettitt
*Assistant Examiner* — Tareq M Alosh
(74) *Attorney, Agent, or Firm* — Fish & Associates, PC

(57) ABSTRACT

NGL recovery from natural gas is achieved by processing the natural gas in a scrub column that operates at high pressure. A C3+ depleted vapor stream is generated from the vapor portion of partially condensed scrub column overhead and expanded to provide refrigeration for the vapor portion to so form a second reflux stream and the C3+ depleted vapor stream. The C3+ depleted vapor stream is then combined with another vapor portion of partially condensed column overhead to produce a lean liquefaction feed stream.

8 Claims, 1 Drawing Sheet

CONFIGURATIONS AND METHODS OF HEATING VALUE CONTROL IN LNG LIQUEFACTION PLANT

This application claims priority to our U.S. provisional application with the Ser. No. 61/393,617, which was filed Oct. 15, 2010.

FIELD OF THE INVENTION

The field of the invention is natural gas liquids (NGL) recovery and liquefied natural gas (LNG) liquefaction for heating value control for LNG export, and particularly integrated plant configurations of such processes to existing LNG plants.

BACKGROUND OF THE INVENTION

With the rapid increase of LNG regasification facilities in Europe and North America, LNG traders are directing their export focus to these countries in addition to various Asian countries such as Japan, Korea, and China. While most Asian countries prefer a high Btu content natural gas, North American pipeline specification restricts the import to low Btu value content gases, for emission control reasons. Hence, in traditional LNG liquefaction plants, NGL removal is limited to C5 and heavier hydrocarbons to avoid plugging of the cryogenic exchanger, and most of the lighter NGL components are liquefied together with the methane component, resulting in LNG with a fairly high Btu content. When such LNG is exported to North America or Europe, deep removal of the NGL components is typically necessary prior to LNG liquefaction, in order to meet the relatively low heating value specification, ranging from 960 Btu/scf to 1100 Btu/scf.

Alternatively, the rich LNG when imported to the LNG regasification terminals, can be diluted with nitrogen, or blended with a leaner natural gas to lower its heating value or Wobbe Index. However, there are upper limits on the amount of nitrogen and inerts that can be introduced to the pipeline gas, and in most cases, a lean gas source is not readily available. Moreover, dilution with nitrogen requires an air separation plant to produce the nitrogen, which is energy intensive and costly and produces no environmental benefit.

Therefore, to compete in the LNG export markets, LNG liquefaction plants must be provided with the flexibility to produce different heating value LNG for export to different customers. This means the LNG liquefaction plants are required to add an NGL recovery unit for the removal of the lighter NGL components when exported to Europe or North America. While the cost of these NGL recovery units may be justified for larger LNG plants, it is often not economical for smaller LNG plants, particularly when retrofitting existing LNG plants.

There are numerous configurations and methods known in the art for high recovery of C3+ components from a natural gas feed. However, all these known processes are complex and costly. Some of the NGL/LNG integrated examples include the expander processes described in U.S. Pat. No. 4,157,904 to Campbell et al., U.S. Pat. No.4,251,249 to Gulsby, U.S. Pat. No. 4,617,039 to Buck, U.S. Pat. No. 4,690,702 to Paradowski et al., U.S. Pat. No. 5,275,005 to Campbell et al., U.S. Pat. No. 5,799,507 to Wilkinson et al., and U.S. Pat. No. 5,890,378 to Rambo et al. Other C3+ recovery methods are also known, as exemplified by U.S. Pat. No. 6,308,531 to Roberts et al, where a side stream from the cryogenic exchanger is processed in a scrub column for the removal of the heavier hydrocarbons. These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

While these processes can achieve heating value reduction to at least some extent, removal of C3+ components is limited, especially at high pressure (e.g., 700 psig and greater) where separation of C3+ components from C2 and lighter components is difficult. Consequently, when processing a rich gas with a high C2 content (e.g., 10% and higher), these processes will often require excessive refrigeration and may no longer be economical.

In still further known configurations, as described for example in U.S. App. No. 2007/0157663, an NGL recovery unit provides a low-temperature and high-pressure overhead product directly to the LNG liquefaction unit and feed gas cooling and condensation are performed using refrigeration cycles that employ refrigerants other than the demethanizer/absorber overhead product. Thus, the cold demethanizer/absorber overhead product is compressed and delivered to the liquefaction unit at significantly lower temperature and higher pressure without net compression energy expenditure. While such systems and methods provide certain advantages, various drawbacks nevertheless remain. Among other things, external refrigeration may become cost-prohibitive, and operational flexibility is often not readily implementable.

Thus, while numerous plant configurations and methods for NGL recovery and LNG liquefaction are known in the art, all or almost all of them, suffer from various disadvantages. Thus, there is still a need for improved NGL recovery and LNG liquefaction, and especially plants in which NGL recovery and LNG liquefaction are integrated.

SUMMARY OF THE INVENTION

The inventor has now discovered that flexible NGL recovery from natural gas can be readily implemented in a conceptually simple and economically attractive manner for both de novo as well as retrofit plants where a second, C3+ enriched reflux stream is produced. Most preferably, the second reflux stream is generated by expansion of a C5+ depleted vapor fraction of the column overhead to so minimize external refrigeration.

In one especially preferred aspect, an NGL recovery plant includes a scrub column that receives a cooled natural gas stream and a first and a second reflux stream. Most typically, the scrub column operates at a pressure of at least 500 psi to thereby produce a C3+ enriched bottoms product and a C5+ depleted overhead product. A first cooler cools the C5+ depleted overhead product and a first separator separates the cooled C5+ depleted overhead product into a C5+ depleted vapor fraction and the first reflux stream, while a second cooler cools a first portion of the C5+ depleted vapor fraction using refrigeration generated by expansion of a C3+ depleted vapor stream, and a second separator separates the so cooled first portion of the C5+ depleted vapor fraction into the C3+ depleted vapor stream and the second reflux stream. The plant is still further configured such that the C3+ depleted vapor stream and a second portion of the C5+ depleted vapor fraction are combined to form a liquefaction feed stream, which is then fed into a liquefaction unit.

In particularly preferred aspects, the scrub column operates at a pressure of at least 700 psi, and an NGL fractionation unit is fluidly coupled to the scrub column to receive the C3+ enriched bottoms product. It is still further generally preferred that a turbo expander and a compressor are operably coupled to each other to receive and expand the C3+ depleted vapor stream and to compress the expanded C3+ depleted vapor stream. In still further preferred aspects, the second cooler is also configured to cool the second reflux stream.

Therefore, a method of recovering NGL from a natural gas may include a step of cooling the natural gas and contacting the cooled natural gas in a scrub column with a first and a second reflux stream at a pressure of at least 500 psi (and more typically at least 700 psi) to thereby produce a C3+ enriched bottoms product and a C5+ depleted overhead product. In another step, the C5+ depleted overhead product is cooled and separated into a C5+ depleted vapor fraction and the first reflux stream. In yet another step, a first portion of the C5+ depleted vapor fraction is cooled using refrigeration generated by expansion of a C3+ depleted vapor stream, and the so cooled first portion is separated into the C3+ depleted vapor stream and the second reflux. The C3+ depleted vapor stream and a second portion of the C5+ depleted vapor fraction are then combined to form a liquefaction feed stream that is subsequently liquefied.

In such methods, it is generally preferred that a ratio between the first and second portions of the C5+ depleted vapor fraction and/or the discharge pressure of the expansion device that expands the C3+ depleted vapor is used to control C3 recovery in the bottom product of the scrub column. It is still further generally preferred that the second reflux is cooled by expansion of the C3+ depleted vapor stream, and/or that cooling of the natural gas and the C5+ depleted overhead product is performed using propane refrigeration. As noted before, it is generally preferred that the C3+ enriched bottoms product of the scrub column is processed in an NGL fractionation unit.

Viewed from a different perspective, the inventor also contemplates a method of recovering NGL from a natural gas having a step of cooling and separating a first portion of a C5+ depleted vapor fraction from an overhead product of a scrub column to produce a second reflux for the scrubbing column and a C3+ depleted vapor stream. In another step, the C3+ depleted vapor stream is expanded in an expansion device to generate refrigeration for the first portion of the C5+ depleted vapor fraction, and in still another step, the expanded C3+ depleted vapor stream is compressed and combined with a second portion of the C5+ depleted vapor fraction to thereby form a liquefaction feed stream, wherein the ratio between the first and second portions of the C5+ depleted vapor fraction and/or discharge pressure of the expansion device is used to control C3 recovery in a bottom product of the scrub column. Suitable ratios between the first and the second portions of the C5+ depleted vapor fraction are typically between 1:1 and 9:1.

Thus, C3 recovery in the bottom product of the scrub column may be controlled by using a ratio between the first and second portions of the C5+ depleted vapor fraction, and/or by controlling the discharge pressure of the expansion device. Most preferably, the C3+ enriched bottoms product is further processed in an NGL fractionation unit, and/or the liquefaction feed stream is liquefied in a downstream liquefaction unit. In further preferred aspects, the scrub column is operated at a pressure of at least 700 psi, and/or the expansion device is a turboexpander that is operably coupled to a compressor that compresses the expanded C3+ depleted vapor stream.

Various objects, features, aspects and advantages of the present invention will become more apparent from the accompanying drawing and the following detailed description of preferred embodiments of the invention.

DETAILED DESCRIPTION

Figure 1:
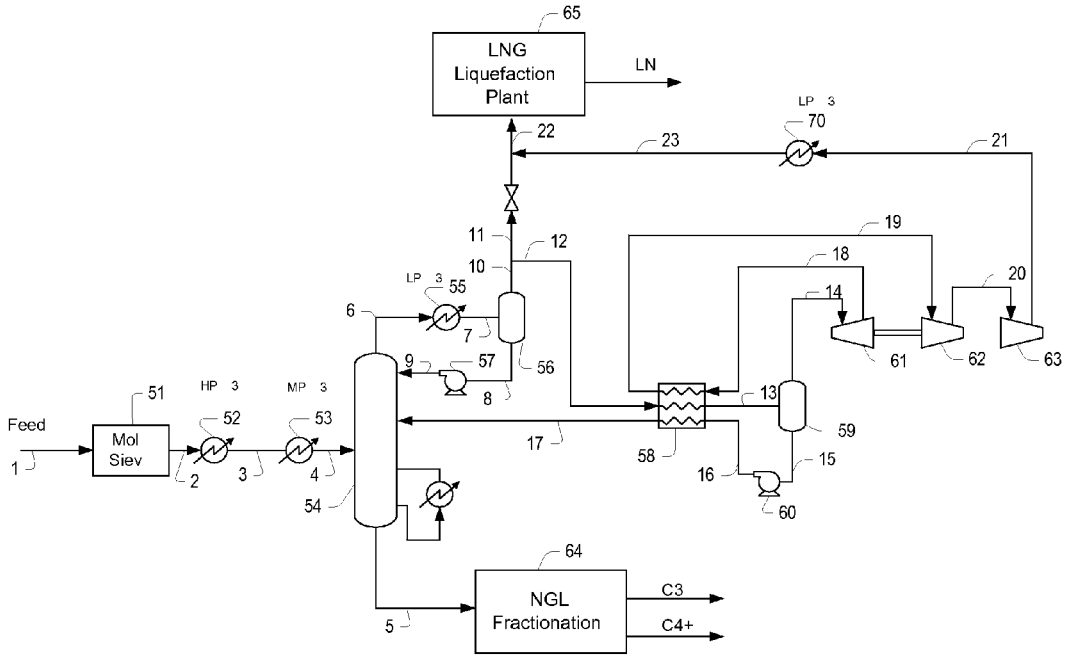
FIG. 1 is a schematic of an exemplary plant configuration according to the inventive subject matter.

The inventor has now discovered that flexible C3+ recovery from natural gas can be readily achieved in de novo as well as retrofitted liquefaction plants by fluidly coupling of a turbo-expander system to a scrub column to produce a second reflux stream to the scrub column. Recovery of C3+ can be varied from 40% to 80% or higher by adjusting the expander flow as necessary to meet the heating value specifications.

Most preferably, the expanded overhead gas from the scrub column in contemplated methods and configuration is employed as a refrigerant after partial expansion via heat exchange with the scrub column overhead gas to produce a second reflux stream to the scrub column. Consequently, it should be appreciated that no external refrigeration is required, avoiding a costly and hazardous complex ethane refrigeration system that would be otherwise required for high NGL recovery.

In most preferred configurations, the feed gas is pre-cooled by propane refrigeration and is then fractionated in a scrub column at relatively high pressure, typically at about 700 psig (e.g., +1-10%). The so formed column overhead is further chilled, typically using a low level propane refrigerant to generate a first column reflux and a C5+ depleted overhead gas. The scrub column also produces a C3+ rich bottoms. At least a portion of the C5+ depleted overhead gas is chilled by a lower pressure expanded gas to −55° F. or lower to thereby produce a second reflux to the scrub column and a C3+ depleted overhead vapor stream. The C3+ depleted overhead vapor stream is then expanded via a turbo-expander and is then used to cool a portion of the C5+ depleted vapor fraction. The so heated low pressure C3+ depleted overhead vapor stream is then recompressed by the turbo-expander and a second compressor feeding the LNG liquefaction plant (typically after combination with another portion of the C5+ depleted vapor fraction).

Consequently, it should be appreciated that the scrub column is configured to separately receive a first and a second reflux stream, wherein the first reflux stream is produced using propane refrigeration on the scrub column overhead while the second reflux stream is produced using refrigeration produced by turbo-expansion using the scrub column overhead gas as a cooling medium. In such configurations, it is generally preferred that a flow control valve (or other flow control implement) varies the flow to the turbo-expander system to meet the desirable overall C3+ recoveries, typically ranging from 40% to 80%.

Therefore, and as described in more detail below, it is generally contemplated that an NGL recovery plant will include a scrub column operating at a pressure of at least 500 psi that receives a cooled natural gas stream and two separate reflux streams, and producing a C3+ enriched bottoms product and a C5+ depleted overhead product. A first cooler and a first separator are typically coupled to the scrub column and configured to allow production of a C5+ depleted vapor fraction and the first reflux stream from the cooled C5+ depleted overhead product. A second cooler then cools a first portion of the C5+ depleted vapor fraction using refrigeration generated by expansion of a C3+ depleted vapor stream, and a second separator then separates the cooled first portion of the C5+ depleted vapor fraction into the C3+ depleted vapor stream and the second reflux stream. A liquefaction feed stream is then formed by combining the C3+ depleted vapor stream and a second portion of the C5+ depleted vapor fraction (10), and the liquefaction feed stream is then fed to a liquefaction unit to liquefy the liquefaction feed stream.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously. As further used herein, the term "depleted" in conjunction with a hydrocarbon fraction in a second stream means that the quantity of the hydrocarbon fraction in the second stream is smaller than the quantity of the same hydrocarbon fraction in first stream from which the second stream is formed. Likewise, the term "enriched" in conjunction with a hydrocarbon fraction in a second stream means that the quantity of the hydrocarbon fraction in the second stream is larger than the quantity of the same hydrocarbon fraction in first stream from which the second stream is formed. For example, where a natural gas stream is separated into a C3+ enriched bottom product and a C5+ depleted overhead product, the bottom product has a higher C3+ fraction than the natural gas stream and the overhead product has a lower C5+ fraction than the natural gas stream. As still further used herein, the term "C3+" refers to hydrocarbons and isoforms thereof having 3 or more carbon atoms (e.g., propane propylene, butane, isobutane, etc.), the term "C4+" refers to hydrocarbons and isoforms thereof having 4 or more carbon atoms (e.g., butane, isobutane, pentane, etc.), and the term "C5+" refers to hydrocarbons and isoforms thereof having 5 or more carbon atoms (e.g., pentane, hexane, benzene, etc. etc.).

In FIG. 1, natural gas stream 1 is a feed stream, typically with a heating value of 1150 Btu/scf, enters the plant at about 750 psig and 120° F. Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary. Water is removed from the feed gas in molecular sieve unit 51 forming a dried gas stream 2. The dried gas is cooled in cooler/exchanger 52, typically using high pressure propane refrigeration to typically 0° F., forming stream 3, which is further chilled in cooler/exchanger 53 to −15° F., typically via medium pressure propane refrigeration, forming cooled natural gas stream 4. The so chilled gas is fractionated in a scrub column 54, using low pressure propane refrigeration for C5+ depleted overhead product 6 at the column overhead in reflux exchanger/cooler 55, producing a chilled two phase stream 7, typically at −35° F. The cooled C5+ depleted overhead product 7 is separated in reflux drum/separator 56, producing an C5+ depleted vapor fraction as stream 10 and a liquid stream 8. The reflux liquid is pumped by pump 57 forming reflux stream 9 and is used as the first reflux to the scrub column. The C3+ enriched bottom product of the scrub column (stream 5) containing mostly the C3 and C4+ components is sent to the NGL fractionation unit 64 which produces the C3 and C4+ product streams for storage, sale, or export.

Due to the high operating pressure of the scrub column (700 psig and higher), separation of C3 from the C2 and light components is difficult due to the low relative volatility which limits the extent of C3 recovery. As a result, a significant amount of C3 would be retained in the overhead gas, resulting in a fairly high heating value gas feeding the LNG liquefaction plant. To reduce the heating value of the overhead gas, a portion (stream 12) of the C5+ depleted vapor fraction 10 (ranging from 50% to 90%) is chilled in cooler/exchanger 58 to typically −55° F. to −75° F. forming stream 13, a cooled portion of the C5+ depleted vapor fraction. The two phase stream is separated in separator 59 producing a lean C3+ depleted vapor stream 14 and a C3 rich liquid stream 15. The liquid stream is pumped by pump 60 to about 750 psig forming stream 16, heated in exchanger 58 to about −20° F. to 0° F., and fed to the scrub column as the second reflux stream 17 to a location that is at least one tray below that of stream 9.

The chilled vapor from separator 59, stream 14, is expanded in an expansion device 61 (typically a turbo-expander) to a lower pressure at about 600 psig that chills the gas to a lower temperature, typically at −70° F. to −85° F., forming stream 18. The chilled expanded vapor is heat exchanged in exchanger 58 that cools the overhead gas from −35° F. to −55° F. or lower. The heated vapor 19 is then compressed by the compressor 62 driven by the turbo-expander 61 forming stream 20 which is further compressed by compressor 63. The compressed gas stream 21 is further chilled with propane refrigeration in exchanger 70 to about −35° F. forming stream 23, mixed with the second portion of the C5+ depleted vapor fraction (bypass stream 11) to form liquefaction feed stream 22 and fed to the LNG liquefaction plant 65. It should be appreciated that the level of C3 recovery can also be varied by adjusting the refrigeration levels by varying the expander discharge pressure (in stream 18). Lowering the expander discharge pressure would lower the discharge temperature, increasing the available refrigeration for a deeper C3+ recovery, which is required when processing a rich gas with greater than 10% C2 content.

Consequently, it should be appreciated that a method of recovering NGL from a natural gas will include a step of cooling the natural gas and contacting the cooled natural gas in a scrub column with a first and a second reflux stream at a pressure of at least 500 psi (and more typically at least 700 psi) to thereby produce a C3+ enriched bottom product and a C5+ depleted overhead product. The so formed C5+ depleted overhead product is then cooled and separated into a C5+ depleted vapor fraction and the first reflux stream. As noted before, the C5+ depleted vapor fraction is split into two portions, and a first portion of the C5+ depleted vapor fraction is cooled, preferably using refrigeration generated by expansion of a C3+ depleted vapor stream. The so cooled fraction is then separated into the C3+ depleted vapor stream (that is then expanded) and the second reflux. After recompression, the C3+ depleted vapor stream is then combined with a second portion of the C5+ depleted vapor fraction to so form a liquefaction feed stream, which is subsequently liquefied in a liquefaction unit.

Therefore, it should be noted that contemplated methods and plants allow for significantly simplified control over C3+ recovery from a natural gas stream without the requiring additional external refrigeration. Indeed, it should be recognized that the ratio between the first and second portions of the C5+ depleted vapor fraction and/or the discharge pressure of the expansion device can be employed to control C3 recovery in the bottom product of the scrub column. For example, where the amount of stream 12 relative to stream 11 is increased, C3+ recovery at the bottom product of the scrub column increases. Alternatively, or additionally, it should be noted that the turboexpander discharge pressure could be lowered to thereby increase cooling of the C5+ depleted vapor fraction, which in turn increases C3+ recovery. Typically, stream 12 will range between 10% and 90% of stream 10, and more typically between 20% and 80% of stream 10. Thus, and viewed from a different perspective, the ratio between the first and the second portions of the C5+ depleted vapor fraction is typically between 1:1 and 9:1. Of course, the C3+ enriched bottom product may be used for various purposes, and among other options, it is generally preferred to use the bottom product as feed stream to an NGL fractionation unit.

Alternatively, in less preferred aspects, contemplated configurations and methods are also deemed suitable for situations where liquefaction is not desired, but where upgrading of natural gas is the objective prior to transmission of the treated gas into a pipeline system. Thus, the feed gas need not be limited to raw or pretreated export natural gas, but all sources of natural gas (including from regasification of LNG) are deemed suitable for use herein. Additionally, while propane refrigeration is typically preferred, alternative refrigeration processes are also contemplated, and especially include those in which refrigeration content from LNG form the liquefaction unit is used (typically, but not necessarily, via an intermediate heat transfer fluid). Still further suitable aspects, modifications, and processes are provided in our U.S. patent application with the publication number US2007/0157663A1, which is incorporated by reference herein.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A method of recovering NGL from a natural gas comprising:

cooling and separating an overhead product of a scrub column to produce a C5+ depleted vapor fraction and a first reflux for the scrub column;

cooling and separating a first portion of the C5+ depleted vapor fraction to produce a second reflux for the scrub column and a C3+ depleted vapor stream.

expanding the C3+ depleted vapor stream in an expansion device to generate refrigeration for the first portion of the C5+ depleted vapor fraction;

compressing and combining the expanded C3+ depleted vapor stream with a second portion of the C5+ depleted vapor fraction to thereby form a liquefaction feed stream; and using a ratio between the first and second portions of the C5+ depleted vapor fraction and/or a discharge pressure of the expansion device to control C3 recovery in a bottom product of the scrub column.

2. The method of claim 1 wherein the C3 recovery in the bottom product of the scrub column is controlled by using a ratio between the first and second portions of the C5+ depleted vapor fraction.

3. The method of claim 1 wherein the C3 recovery in the bottom product of the scrub column is controlled by controlling the discharge pressure of the expansion device.

4. The method of claim 1 further comprising a step of processing the C3+ enriched bottoms product in an NGL fractionation unit.

5. The method of claim 1 further comprising a step of liquefying the liquefaction feed stream in a downstream liquefaction unit.

6. The method of claim 1 wherein the scrub column is operated at a pressure of at least 700 psi.

7. The method of claim 1 wherein the expansion device is a turboexpander that is operably coupled to a compressor that compresses the expanded C3+ depleted vapor stream.

8. The method of claim 1 wherein the ratio between the first and the second portions of the C5+ depleted vapor fraction is between 1:1 and 9:1.

* * * * *